US005859378A

United States Patent [19]

Freeland et al.

[11] Patent Number: 5,859,378

[45] Date of Patent: Jan. 12, 1999

[54] MUSICAL INSTRUMENT SELF-TUNING SYSTEM WITH CAPO MODE

[75] Inventors: Stephen J. Freeland; Neil C. Skinn, both of Fort Collins, Colo.

[73] Assignee: Transperformance LLC, Littleton, Colo.

[21] Appl. No.: 679,071

[22] Filed: Jul. 12, 1996

Related U.S. Application Data

[60] Provisional application No. 60/001,172 Jul. 14, 1995.

[51] Int. Cl. [6] ..... G10D 3/14; G10G 7/02

[52] U.S. Cl. ..... 84/454; 84/DIG. 18

[58] Field of Search ..... 84/454, 297 R, 84/298, 307, DIG. 18

[56] References Cited

U.S. PATENT DOCUMENTS

| | | | |
|---|---|---|---|
| 3,144,802 | 8/1964 | Faber, Jr. et al. | 84/454 |
| 4,044,239 | 8/1977 | Shimauchi et al. | 235/151.3 |
| 4,088,052 | 5/1978 | Hedrick | 84/454 |
| 4,196,652 | 4/1980 | Raskin | 84/453 |
| 4,426,907 | 1/1984 | Scholz | 84/454 |
| 4,584,923 | 4/1986 | Minnick | 84/454 |
| 4,803,908 | 2/1989 | Skinn et al. | 84/454 |
| 4,856,404 | 8/1989 | Hughes, Sr. | 84/297 R |
| 4,909,126 | 3/1990 | Skinn et al. | 84/454 |
| 4,947,726 | 8/1990 | Takabayashi | 84/743 |
| 4,958,550 | 9/1990 | Kugimoto | 84/454 |
| 5,009,142 | 4/1991 | Kurtz | 84/454 |
| 5,038,657 | 8/1991 | Busley | 84/455 |
| 5,095,797 | 3/1992 | Zacaroli | 84/455 |
| 5,323,680 | 6/1994 | Miller et al. | 84/455 |
| 5,343,793 | 9/1994 | Pattie | 84/454 |

FOREIGN PATENT DOCUMENTS 2049226 4/1983 United Kingdom .

OTHER PUBLICATIONS

"Digital Tuning System DTS–1 Owner's Manual", TransPerformance, Fort Collins, CO, Mar. 1993.

*Primary Examiner*—Brian Sircus
*Assistant Examiner*—Marlon T. Fletcher
*Attorney, Agent, or Firm*—Greenlee, Winner & Sullivan, P.C.

[57] ABSTRACT

The invention is a control system for automatically tuning a stringed musical instrument with a capo installed, using an original calibration function or closed-loop tuning system for the instrument without the capo. The control system uses a capo scale factor which scales frequencies measured with the capo installed to what they would have been without a capo. The control system enables a musician to quickly tune an instrument after installing a capo, in a manner unlikely to be noticed by an audience.

53 Claims, 5 Drawing Sheets

MUSICAL INSTRUMENT SELF-TUNING SYSTEM WITH CAPO MODE

This application is based on Provisional Application Ser. No. 60/001,172 filed Jul. 14, 1995, which is incorporated herein by reference in its entirety.

FIELD OF THE INVENTION

This invention relates to a control system for an automatically tuned fretted stringed instrument adapted for use with a capo installed.

BACKGROUND OF THE INVENTION

Manually tuning a musical instrument can be a difficult and tedious process, usually requiring a considerable amount of time and skill. Although having an automatic tuning system is desirable for ease and convenience, as well as for accuracy, there is another important reason. Frequently, a musician will need to change the tuning of an instrument during a performance or an instrument will go out of tune during a performance. And, during this process, it may be necessary to compensate for a change in an instrument's characteristics. For example, during a performance with a guitar, a musician may install a capo between selections. A capo is a device for clamping all strings to a particular fret, thereby increasing the frequencies of all strings by a constant factor. Because of the time required, manually retuning an instrument during a performance is usually unacceptable. One common, although expensive and inconvenient, solution to this problem is to have properly tuned spare instruments available for such occasions. A much better solution is to have a system for automatically tuning an instrument within a length of time short enough to be unnoticed by an audience.

Many different types of automatic tuning systems have been devised. There are open-loop systems which drive a tuning actuator to a predetermined position for each desired frequency. These have the advantage of being able to change tuning, silently and therefore unnoticed, during a performance. However, they have the disadvantage of being only as accurate as the predicted relationship between the frequency of the tone produced by the instrument and the actuator position.

There are closed-loop systems which measure the frequency of the tone produced by the instrument, compare it to a desired value, and use the result of the comparison to control an actuator which tunes the instrument. This technique is accurate in that it directly controls the frequency of the instrument and is independent of other factors which affect frequency. However, it has the disadvantage that an audible tone must be produced while the instrument is being tuned; and that audible tone generally precludes tuning during a performance.

Some stringed instrument systems, because of interactions between strings, sequentially tune each string and then iterate to compensate for the interactions. Others tune selected strings, or all strings, simultaneously and then iterate. These techniques require producing a tone, taking a frequency measurement, estimating and executing an actuator movement, then taking a new frequency measurement and repeating the process until the frequency produced is sufficiently close to the desired frequency.

Other systems measure the tension of (actually, the force applied to) a string and compare the measured value with a desired value to produce an actuator control signal. Although the string tension method does not require a tone to be produced while tuning, it does require a known and stable relationship between string tension and frequency. Satisfying this relationship requirement is difficult because frequency also depends on string length and mass per unit length as well as other factors.

A typical stringed musical instrument has a semi-rigid structure which changes form slightly when string tensions in the instrument are adjusted during tuning. A change in form due to the adjustment of one string therefore affects the frequencies of the remaining strings. Temperature and humidity also affect the form, and the frequencies, of the instrument in more subtle ways.

A system which compensates for the effect of adjusting one string on the frequencies of the remaining strings, described in U.S. Pat. Nos. 4,803,908 and 4,909,126 to Skinn et al., which are incorporated by reference herein in their entirety, involves the use of a calibration function which relates the position of each actuator to the frequencies produced by all the instrument's strings. Creating the calibration function involves the measurement of frequencies at multiple positions of each actuator and, through regression techniques, relating the position of each actuator to not only the frequency of its own string but to the frequencies of the other strings as well. The use of regression techniques provides the advantage that a priori knowledge of the detailed characteristics of the instrument being tuned is not required. Also, the calibration function can be updated by recalibration as the instrument ages, or as environmental or other changes occur. Using a calibration function generated from the particular instrument being tuned permits open-loop, and therefore silent, tuning with accuracy comparable to that of closed-loop systems.

In all of the previously described open-loop systems, a calibration function relates a desired frequency to an actuator position. However, if such a system is calibrated without a capo and then a capo is installed, this relationship is destroyed and the system must be recalibrated for each position of the capo. It is therefore an object of this invention to provide for automatically tuning a stringed musical instrument after installing a capo without having to recalibrate the system.

In closed-loop systems wherein the measured frequency is compared to a desired frequency, installation of a capo shifts the measured frequency relative to the desired open string frequency and thereby skews the comparison. It is therefore a further object of this invention to provide for automatic closed-loop tuning of a string instrument after installing a capo.

SUMMARY OF THE INVENTION

The invention is a control system for automatically tuning a stringed musical instrument with a capo installed, using an original calibration function or tuning system for the instrument without the capo. The control system uses a capo scale factor to scale the frequencies measured with the capo installed in order to obtain the frequencies that would have been produced without a capo. The control system enables a musician to quickly tune an instrument after installing a capo, in a manner unlikely to be noticed by an audience.

When a capo is installed on an instrument, the vibrating portion of every string is ideally shortened by the same amount and the frequency of every string increases by the same factor. This factor is a function of the position of the capo along the string. For the case where the capo is clamped on a fret and there are 12 frets per octave, the frequencies each increase by $2^{(n/12)}$, where n is the number of the fret on which the capo is installed. In both open- and closed-loop tuning systems, the measured frequencies are multiplied by a capo scale factor, which is the reciprocal of the frequency increase factor, to obtain scaled frequencies, and the scaled frequencies are used by the control system in lieu of open string frequencies. The capo position, n, can be input by the musician or determined directly by the control system.

In an open-loop system having a calibration function, the scaled frequencies are used within the original calibration function to compensate for the installation of the capo. However, in addition to the primary effect of shortening the vibrating length of the strings, the capo causes secondary effects such as changing the string tension. Thus the original calibration function requires slight adjustments to correct for secondary effects of the capo. In the preferred embodiment, the calibration function can be rapidly updated following installation of a capo.

BRIEF DESCRIPTION OF THE DRAWINGS

The above-mentioned and other features and objects of the invention and the manner of attaining them will become more apparent and the invention itself will best be understood by reference to the following description of embodiments of the invention taken in conjunction with the accompanying drawings, a brief description of which follows.

FIG. 3, comprising

DESCRIPTION OF THE PREFERRED EMBODIMENT

Figure 1:
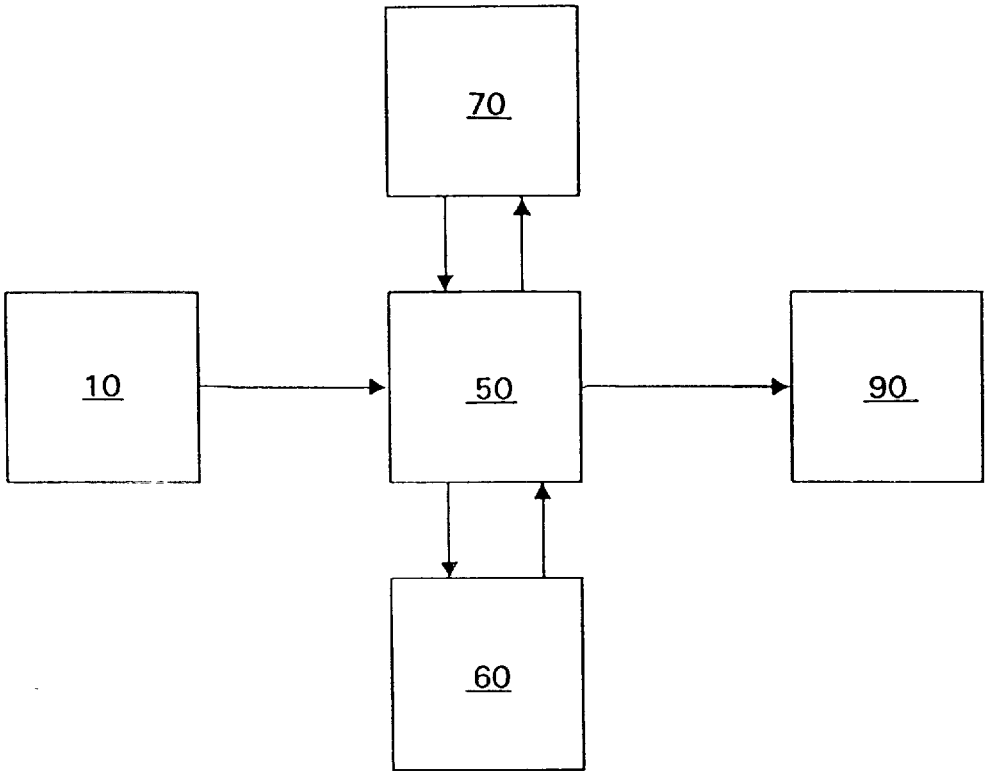
FIG. 1 is a block diagram of an automatic tuning system utilizing this invention.

When reference is made to the drawings, like numerals indicate like parts and structural features in the various figures. Also, herein, the following definitions apply:

- transducer: any device for providing a signal from which the frequency can be obtained;
- actuator: a device for changing a frequency of the instrument in response to a control signal;
- actuator position: a particular actuator output affecting frequency, such as angle, force, pressure or linear position;
- calibration function: any function relating frequency and actuator position and may be represented by, and stored as, a set of coefficients for a specific mathematical expression or as values in a look-up table;
- open frequency: frequency of a string without fretting by either an installed capo or manual fretting;
- target frequency: a desired frequency to which a string is to be tuned, generally without fretting (i.e., target open frequency);
- tuning configuration: a group of target frequencies (one per string) which comprise a particular target tuning of an instrument;
- cents: a measure of frequency in which 100 cents equal one half-step; i.e., 1200 cents equal one octave; and
- wherein the terms frequency and period are regarded as equally unambiguous measures of frequency.

The invention is a control system for automatically tuning a stringed musical instrument with a capo installed, using an original calibration function or tuning system for the instrument without the capo.

When a capo is installed on a stringed instrument such as a guitar, the open frequency $f_{open}$ of a string is changed to a new frequency $f_{capo}$ as predicted by the following equation:

$$\frac{f_{capo}}{f_{open}} = 2\left(\frac{n}{12}\right)$$

where n is the number of the fret, relative to the nut, on which the capo is clamped. When no capo is installed, n=0. This equation assumes 12 frets per octave. For other intervals it can be modified accordingly. The relationship between the open and the capoed frequency can be used to scale a measured frequency, $f_{meas}$, in order for the processor to use the scaled frequency $f_s$ to generate control signals. The measured and scaled frequencies are related by a capo scale factor according to:

$$f_s = 2^{-(n/12)} f_{meas}.$$

Scaling the measure frequencies in this way essentially "tricks" the processor into tuning the instrument as if there were no capo installed. The scaled frequencies used by the processor imitate the open frequencies which would have been obtained in the absence of the capo.

Detecting an installed capo can be done automatically by the processor by comparing the measured frequency to the target open frequency. If the ratio is not unity, n can be determined and the matching capo scale factor can be applied to the measured frequency. If the ratio yields an non-integer value of n, the nearest integer is selected. The ratio can be measured for more than one string and the average used to determine the capo position. The instrument can also be equipped with a capo sensor which, for example, detects electrical contact between a string and a fret. The scaling can also be selected manually by the user through an operator interface. The user can specify on which fret a capo is installed or can indicate the installation of a capo and allow the processor to determine n.

A functional block diagram of the control system and its connection to other elements of the tuning system is shown in FIG. 1. Transducer 10 is coupled to processor 50 which is in turn connected to actuator 90. Operator interface 70 and memory 60 are also connected to processor 50. Transducer 10 produces an electrical signal representing a sound produced by the instrument (not shown).

Transducer 10 is any device for providing a signal from which the frequency can be obtained. Examples of transducers include devices sensitive to sound waves such as microphones, magnetic or electric field sensing devices coupled to vibrating elements of an instrument, optical sensors coupled to vibrating elements, and transducers sensitive to frequency-related phenomena such as strain gauges measuring tension in strings of stringed instruments. The term transducer is used in the singular to refer to one or a plurality of devices coupled to the strings. Depending on the particular transducer, the coupling to the strings can be, for example, mechanical, electrical, optical, through sound waves, or through a magnetic field.

The transducer signal can be conditioned for use by processor 50, for example by Schmitt triggers which convert an analog signal into a binary signal and prevent edge slivers in the binary signal. Other devices for conditioning a frequency signal for use by a processor include amplifiers, buffers, comparators, filters, and various forms of time delays and voltage level shifting. The signal conditioning elements can be incorporated in the processor or in the transducer.

Processor 50 includes a means for obtaining the frequency of each string from the transducer signal. Frequency measuring techniques include timers measuring the periods of signals, such as digital counters implemented in either hardware or software, and digital counters counting the number of cycles of a signal in a period of time. Other techniques include the use of Fourier transforms or other processing algorithms, analog or digital filters, and digital signal processors.

The processor includes a means for outputting control signals to actuators connected to the instrument's strings. There are many types of actuators adaptable to tuning an instrument, including electromechanical devices such as stepper motors, servo motors, linear motors, gear motors, leadscrew motors, piezoelectric drivers, shape memory metal motors, and various magnetic devices. Position reference devices for actuators include electrical contacts, optical encoders and flags, potentiometers, and mechanical stops for stepper motors. Many other types of apparatus will be obvious to those skilled in the art of control systems. A preferred embodiment includes the choice of an actuator which holds its position when power is removed; for example, a stepper motor or a gear ratio, leadscrew pitch, lever arm, or ramp with a critical angle such that if the motor produces no torque the tuning does not change. The motors can be connected to the strings by directly attaching a string to a motor shaft, or by various mechanical systems utilizing components such as gears, pulleys, springs and levers. The actuator can change the tension on the string by pulling along the axis of the string or by transverse deflection of the string. Many mechanical actuators for altering string tension have been described in the art. The control system of the present invention can be employed with any actuator. Each string can have more than one actuator attached to it, for example for coarse and fine control of the string frequency.

Various techniques for interconnecting functional blocks are also available to those skilled in the art. In addition to the usual wired connections are optical, ultrasonic, and radio links which permit remote location of portions of the tuning system.

The operation of the control system of this invention is described below, first for a closed-loop system and then for an open-loop system.

In the closed-loop tuning system of this invention, processor 50 obtains a transducer signal from transducer 10 and used it to obtain the measured frequency of each string. Either automatically or by instructions from operator interface 70, processor 50 decides if scaling of the frequencies is necessary. If so, the measured frequency is scaled by the capo scale factor, and processor 50 uses the difference between the scaled frequency and the target open frequency for each string to generate an error signal. A control signal is generated from the error signal and is output to actuator 90. The actuator then moves to reduce the error signal to zero. In order to be able to change tuning configurations in the middle of a song without strumming and waiting for the servos to retune, the closed-loop system can be used before the performance to generate a look-up table of actuator positions for each tuning configuration. A closed loop system can also be used to generate a mathematical calibration function. The details of the implementation of a closed-loop (servo) system providing the function described are readily available in textbooks and catalogs and are familiar to those skilled in the art of control systems.

The open-loop system using a calibration function also uses the scaled frequencies to generate control signals. A calibration function is any function relating frequency to actuator position. In a preferred embodiment a single calibration function can be used to access a plurality of tuning configurations, and the instrument can switch between tuning configurations in the middle of a song without the need for additional tuning. A detailed description of the general calibration function is given first before describing the modification of the calibration function for use with an installed capo.

When tuning the instrument in the open-loop system, processor 50 obtains a calibration function from memory 60 and utilizes it to generate, from a set of target frequencies, control signals which are utilized by actuator 90 to tune the instrument. For a control system to automatically tune all of the strings of an instrument without iteration, the use of empirically derived calibration functions is nearly always necessary. The vibrating frequency of a guitar string depends not only on the position of the actuator controlling the tension in that string but also on the effective length and mass of that string, the tension in all the other strings, the stiffness of the neck of a guitar, etc. The combined effects of these variables on frequency are extremely difficult to predict and therefore the preferred control system has the ability to generate a calibration function of empirically determined shape.

Figure 2:
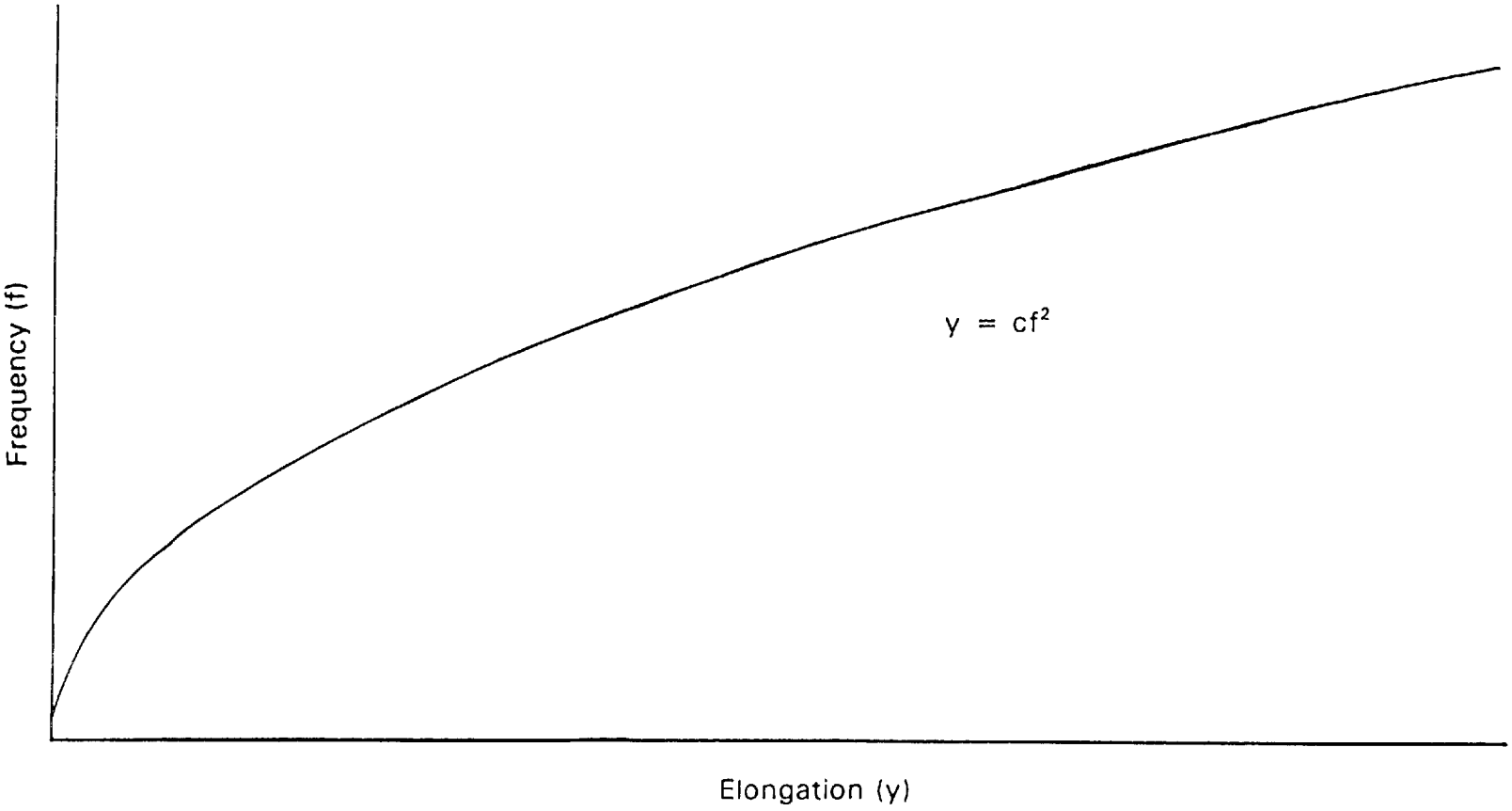
FIG. 2 is a plot of frequency versus elongation for a single string.

A calibration function can have any form which relates actuator position to frequency for the instrument being tuned. For example, a simple model relating elongation and frequency of a vibrating string is plotted in FIG. 2 and described by the equation:

$$y = 4\frac{ML^3}{EA}f^2 \tag{1}$$

where y is the elongation, M is the mass per unit area, L is the length, E is the modulus of elasticity, A is the cross sectional area, and f is the frequency of the string. However, this expression only includes string attributes. Where the elongation y of a string is produced by an actuator, additional system related factors become involved and the relationship between actuator position and frequency is usually considerably more complex than indicated by this simple function. Furthermore, the values of the string attributes themselves are difficult to know precisely due to manufacturing tolerances. It is therefore important to have a system for producing calibration functions with as many terms as necessary to adequately describe the characteristics of the instrument.

Any general (continuous, single valued, etc.) function g(x) can be represented by the Maclaurin series in the following equation:

$$g(x) = g(0) + xg'(0) + \frac{x^2}{2!}g''(0) + \frac{x^3}{3!}g'''(0) + \ldots + \frac{x^n}{n!}g^{(n)}(0) +$$

By recognizing that g(x) and its derivatives $g^{(n)}$ (x) are constants for x=0 and substituting f for x and x for g(x) the function can be rewritten as:

$$x=a+bf+cf^2+df^3+\ldots \tag{2}$$

which relates actuator position x to vibrating string frequency f. Each different set of coefficients a, b, c, . . . , produces a different function. The use of the Maclaurin series permits calibration functions to be defined and stored as sets of coefficients.

Although Eq. 2 in its most general form is an infinite series, most calibration functions are relatively simple and only a few terms are needed to obtain the accuracy required. For example, in the preceding model described by Eq. 1, only the third ($f^2$) term is required. In the preferred embodiment, the values of coefficients a, b, c, etc., of the calibration function are empirically obtained by a calibration process. In the calibration process, a minimum number n of frequencies $f_i$, where $1 \leqq i \leqq n$ and n is the number of unknown coefficients, are measured at n different actuator positions $x_i$. Then each pair of values, $x_i$ and $f_i$, is sequentially inserted into Eq. 2, resulting in n equations with n unknowns which can be solved by conventional techniques for the unknown values of the coefficients. The number n is the minimum number of measurements necessary to solve for the coefficients; more measurements may be needed to obtain statistically valid values for $f_i$ if the measurements are not repeatable.

After the coefficients in Eq. 2 have been determined by the calibration process, an actuator position x can be computed for any given target frequency f within the tuning range of the instrument. Then, the value x can be used to control the actuator and tune the instrument to the frequency f. In obtaining a calibration function f is the measured frequency at a selected actuator position; when using the calibration function f is a selected target frequency used to estimate the necessary actuator position.

Since the calibration function has as many empirically derived terms as necessary to accurately describe the characteristics of the instrument, it can predict an actuator position which will yield the target frequency within a few cents over the entire tuning range of the instrument. However, as an option providing greater accuracy, the following "touch-up" calibration yields the target frequency within ±2 cents.

In the event that the instrument's characteristics change slightly after the initial calibration and all tuning configurations are affected, or if the frequency produced by the instrument for a particular tuning configuration is incorrect, the calibration can be modified or "touched up" by the following methods.

Figure 3A:
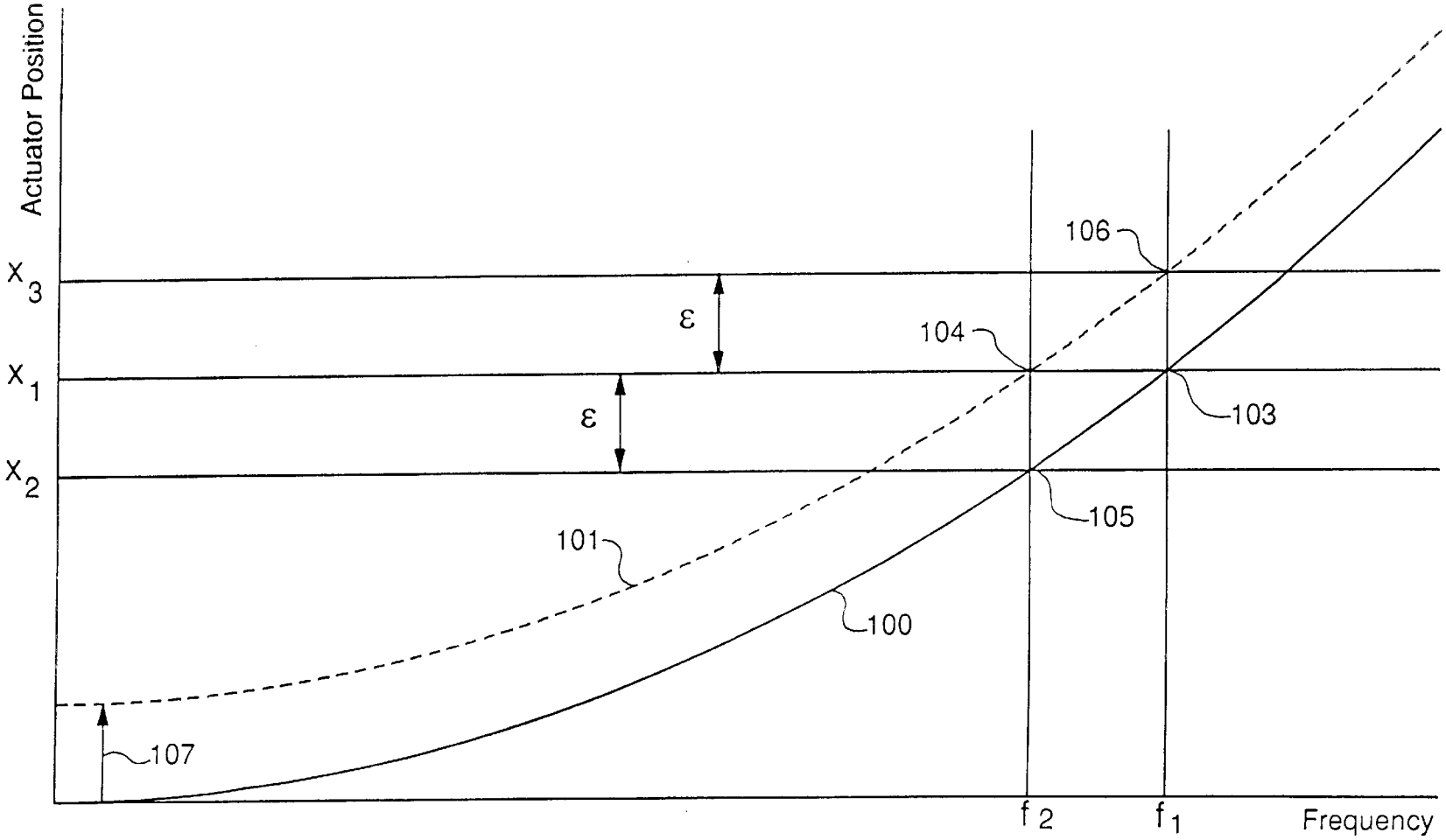
FIGS. 3A–C, shows plots of actuator position versus frequency for a single string showing "touch-up" calibrations.

Referring to FIG. 3A, curve 100 represents the original system characteristic function, described by the calibration function, and curve 101 represents a new (changed) characteristic function. In this example, curve 101 is a simple translation in actuator position x of curve 100 representing, for example, a slip in the position of a tuning peg or the stretching of a string. During touch-up, the actuator is driven in a normal tuning operation to a position $x_1$ corresponding to a target frequency $f_1$ indicated by point 103 on curve 100. The instrument is strummed once and the actual frequency, $f_2$ is measured. On the new characteristic function, curve 101, frequency $f_2$ corresponds to point 104. Using the original calibration function, actuator position $x_2$ is computed from the measured frequency $f_2$ as indicated by point 105. The difference between the two values of actuator position $x_2-x_1=\epsilon$ is computed. This value of $\epsilon$ is used to modify the constant term a in Eq. 2 and therefore affects the computed actuator position for all tunings thereafter. Modifying the constant term in Eq. 2 translates original calibration function 100 vertically upward by the value $\epsilon$, as indicated by arrow 107, to create a new calibration curve which, in this example, corresponds to new characteristic function 101. Using the new calibration function, to achieve target frequency $f_1$ the calculated actuator position is $x_3$, as shown by point 106. In a preferred embodiment $\epsilon$ is obtained for "Standard Tuning" (EADGBE). However, it can alternatively be obtained in a different tuning configuration. In the case when the frequency of only a particular tuning configuration is incorrect, the value of $\epsilon$ is measured and stored for that tuning configuration.

Figure 3B:
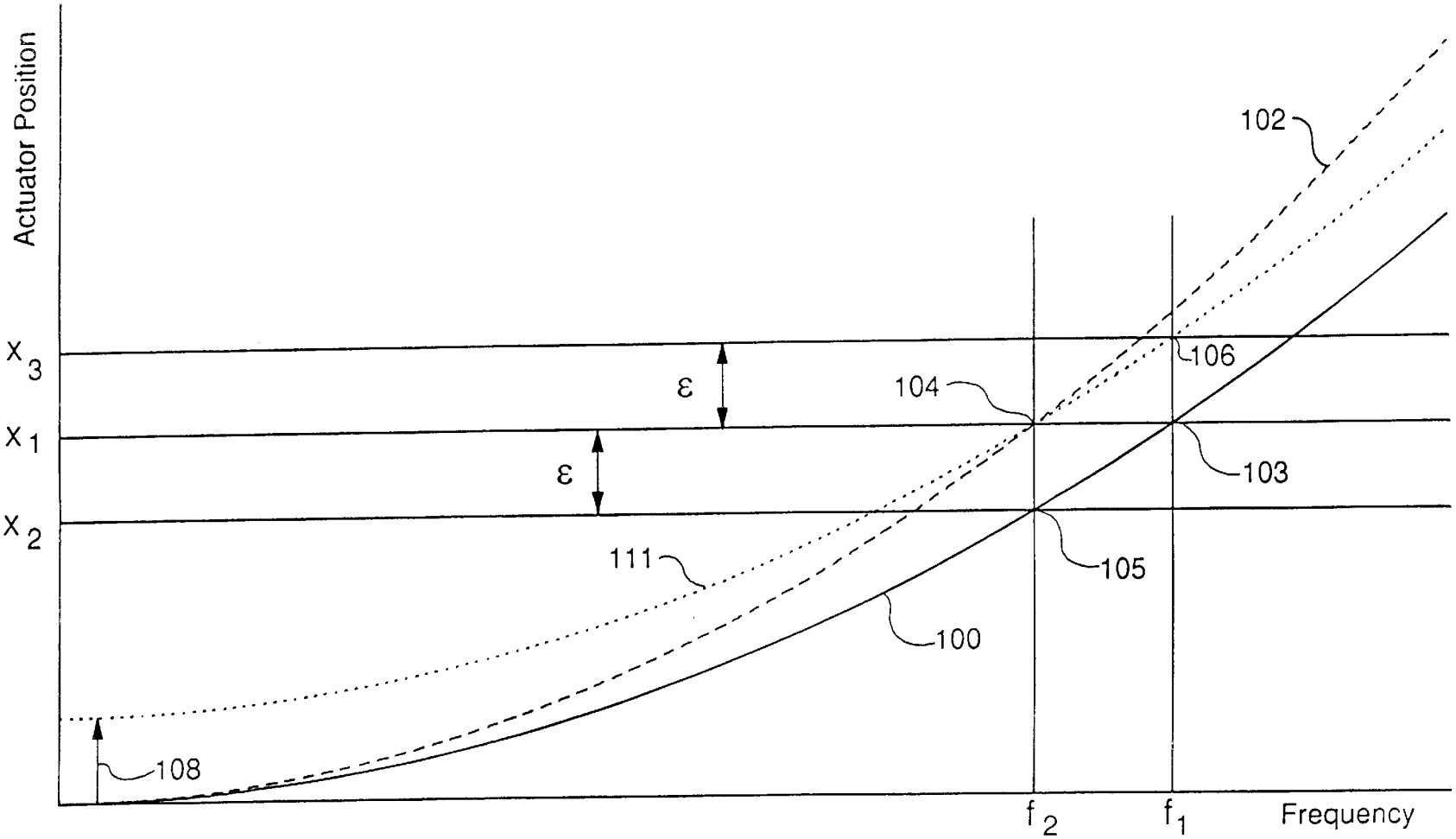

Generally changes in the system calibration are more complex than the simple shift shown in FIG. 3A. Referring to FIG. 3B, curve 100 again represents the original system characteristic function, described by the calibration function, but curve 102 represents another new (changed) system characteristic function. In this case, the new function is not a translation of the original function but is a function having a different curvature. Such a change in the function could be the result of a change in the stiffness of the structure of the instrument, for example. The touch-up in this case can be performed in the same way as in the previous case, that is by translating curve 100 vertically upward, as indicated by arrow 108, to superimpose on curve 102 at point 104. The result is curve 111. This touch-up is accurate only in the neighborhood of the point 104 since curve 111 deviates from curve 102 as the distance from point 104 increases. Using new calibration curve 111, to achieve target frequency $f_1$ the calculated actuator position is $x_3$, as indicated by point 106. Note that point 106 does not fall exactly on new system characteristic function 102, and so the actual touched-up frequency differs slightly from the target frequency.

Figure 3C:
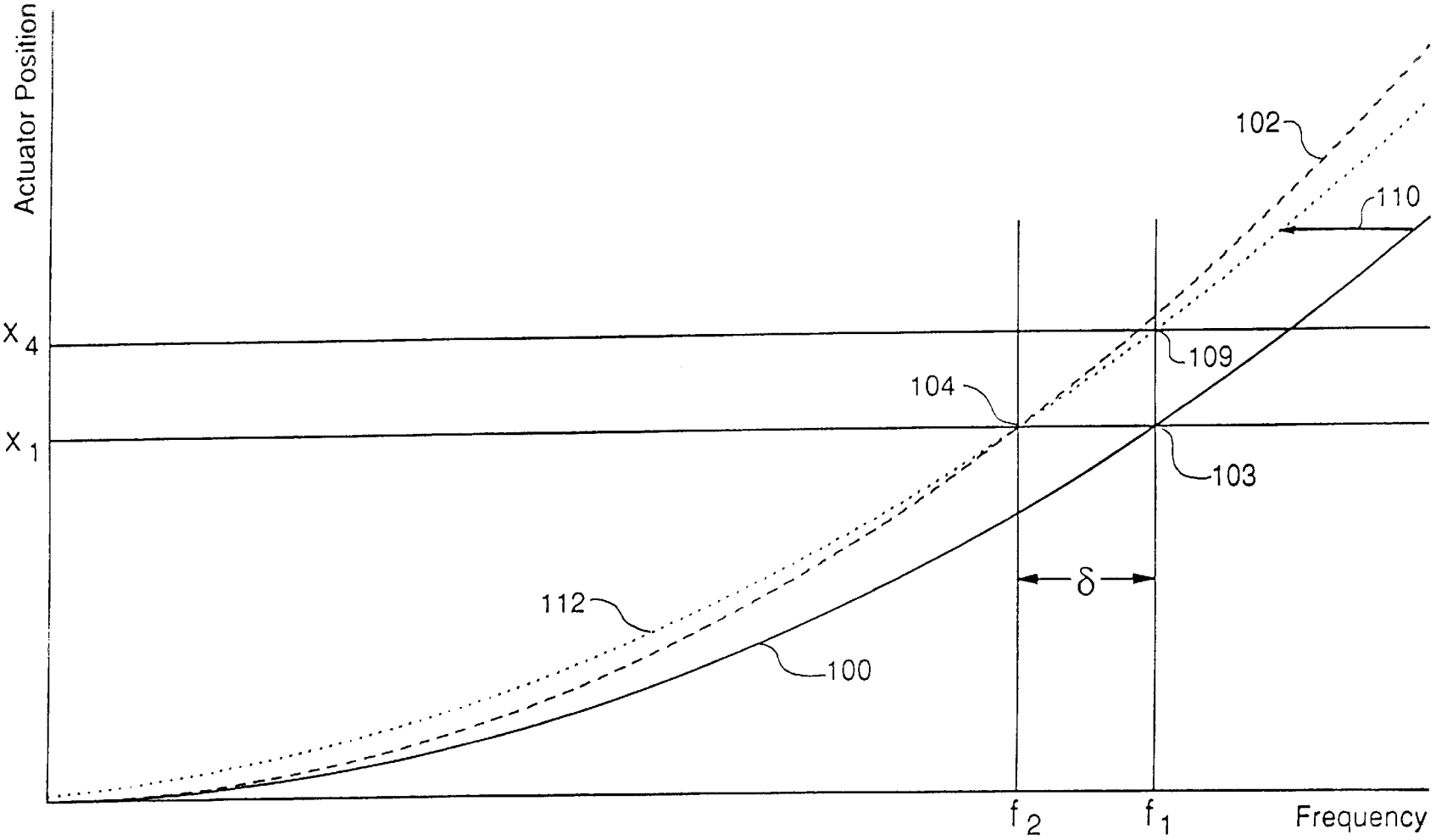

An alternative method of touching-up the calibration is shown in FIG. 3C. Again, curve 100 is the original characteristic function and curve 102 is the new characteristic function. The target frequency is $f_1$, but the frequency actually obtained is $f_2$. Instead of computing a position $x_2$ from the frequency $f_2$, the difference between the actual and the target frequencies $\delta=f_2-f_1$ is computed and stored during the touch-up. New calibration curve 112 is formed by translating curve 100 horizontally to the left by the value $\delta$ as indicated by the arrow 110. The result is indicated by the curve 112. Using new calibration curve 112, to achieve target frequency $f_1$ the calculated actuator position is $x_4$, as indicated by point 109. Note that point 109 does not fall exactly on new system characteristic function 102. The relative accuracy obtained by sliding the calibration function curve horizontally compared to vertically depends on the shape of the changed system characteristic curve (e.g., curve 101 versus curve 102). Both methods provide excellent tuning accuracy. In general, the calibration function is modified based on the difference $\delta$ between the measured and target frequencies ($f_2-f_1$) or the difference $\epsilon$ between the corresponding actuator positions ($x_2-x_1$). A combination of horizontal and vertical translations can also be used.

Although a linear approximation can be used for touch-up, the preceding methods provide greater accuracy because the calibration function itself, instead of a linear approximation, is used to compute the value of $\epsilon$ or $\delta$. Since a calibration function is in general non-linear, the combination of using the calibration function itself and evaluating it at a point already very close to the desired position provides a way of obtaining a very accurate final adjustment of the calibration.

An alternative to the previously described touch-up method utilizes a servo system. In this method, the actuator is driven to the position $x_1$ using a calibration function as previously described. Then the instrument is strummed and the difference between the actual frequency of each string and the target frequency of that string is used to generate an error signal. A control signal is generated from the error signal and is applied to the actuator drive circuits. The actuator then moves to reduce the error signal to zero as in a traditional servo system. In this case, string interactions and other factors affecting frequency need not be considered because the frequency of each string is independently moved to its desired value by the servo system even though the instrument's characteristics may be changing. When all actuators have settled at their final positions, the resulting position values are used to modify the calibration function or stored for subsequent use in tuning the instrument. As described previously, a servo system can also be used, in lieu of a calibration function, for the primary tuning process.

The calibration function described above is adequate for a single string. However, a practical stringed instrument has multiple strings. In this case, the previously described function is expanded to include the other strings as follows:

$$x_1 = a_1 + b_{11}f_1 + c_{11}f_1^2 + d_{11}f_1^3 + \ldots + \quad (3)$$

$$b_{12}f_2 + c_{12}f_2^2 + d_{12}f_2^3 + \ldots + b_{13}f_3 + c_{13}f_3^2 + d_{13}f_3^3 + \ldots + \ldots$$

$$x_2 = a_2 + b_{21}f_1 + c_{21}f_1^2 + d_{21}f_1^3 + \ldots + \quad (4)$$

$$b_{22}f_2 + c_{22}f_2^2 + d_{22}f_2^3 + \ldots + b_{23}f_3 + c_{23}f_3^2 + d_{23}f_3^3 + \ldots + \ldots$$

where the subscripts refer to the strings and associated actuator positions.

The one-dimensional (single actuator, multiple positions) calibration procedure, described for a single string, is expanded into two dimensions (multiple actuators, multiple positions) as required for multiple strings. By storing the actuator position data $x_{jk}$ and the corresponding frequency data $f_{jk}$ for each combination of actuators j (connected to strings j) and positions k, enough independent equations to solve for the unknown coefficients can be generated. The equations can be solved by conventional techniques, including matrix, regression and statistical methods, and the resulting coefficients stored in a non-volatile memory.

The use of the Maclaurin series is a general solution which permits the synthesis of a calibration function of any form. However, if the form of the function is known in advance, e.g. Eq. 1, that function can be substituted for the series. The same kind of calibration process is performed and the task is easier with fewer terms and fewer coefficients than required for a series. Also, as another alternative, a Taylor series as in the following expression:

$$x = g(f_0) + (f - f_0)g'(f_0) + \frac{(f - f_0)^2}{2!}\, g''(f_0) + \frac{(f - f_0)^3}{3!}\, g'''(f_0) + \ldots$$

could be used in place of the Maclaurin series. In this case, the calibration function uses the difference between two frequencies, for example a target frequency and an actual frequency, instead of a single frequency, as an argument during calibration.

Although the calibration functions in the preceding descriptions are empirically derived mathematical equations, the invention may use calibration functions of many other forms. For example, the calibration functions can be based on theoretical models instead of empirical data and can be in the form of look-up tables instead of mathematical functions.

Further details of the open-loop system are given in concurrently filed U.S. application Ser. No. 08/679,080, entitled "Musical Instrument Self-Tuning System with Calibration Library" which is incorporated by reference herein in its entirety.

In the present invention the open-loop system is modified as follows. When a capo is installed the measured frequency is multiplied by the capo scale factor and the scaled frequency is used in the calibration function, as in the following example for a single string:

$$x = a + bf_s + cf_s^2 + df_s^3 + \ldots$$

Indistinguishably, the coefficients b, c, d. . . . can be scaled by multiplying by appropriate powers of the capo scale factor.

An alternative method for using a capo on an automatically tuned instrument is described in the above cited concurrently filed U.S. Patent Application. It utilizes a plurality of calibration functions, including a different calibration function for each capo position. The two can also be used in combination. For example, the stored calibration functions can contain just one capo calibration function, obtained with a capo installed. To tune the instrument with a capo on a different fret, the capo calibration function can be modified with a scaling factor as described above, but in this case n is the difference in fret number between the fret on which the capo is installed and the fret on which it was installed for the capo calibration.

Utilizing the capo scale factor corrects for the first-order effects of an installed capo. However, because of slight changes in string tension, slight string bending, and other factors produced by the capo, the frequency obtained is not exactly equal to that predicted by the scaled calibration function and a modification of the calibration function is often necessary. An advantage of the present invention is that, by scaling the measured frequency, the calibration function can be modified with a single strum instead of requiring a full re-calibration procedure after installing a capo.

The modification can follow the touch-up procedure described above. In the touch-up procedure the original calibration function is used to calculate actuator positions for the target open frequencies. In these actuator positions, the actual frequencies are measured with a single strum and are scaled by the capo scale factor. The calibration function is then modified based on the difference between the scaled measured frequencies and the target open frequencies, or the difference between the corresponding actuator positions calculated by the original calibration function.

The invention has been described for use with a fretted stringed instrument. It can also be used with any non-fretted instrument which uses a capo. In a fretted instrument the capo clamps the strings at a fret and that fret effectively becomes the new nut. In a non-fretted instrument, the capo includes a metal bar against which the strings are clamped to form a new nut.

While the invention has been described above with respect to specific embodiments, it will be understood by those of ordinary skill in the art that various changes in form and details may be made therein without departing from the spirit and scope of the invention which receives definition in the following claims.

We claim:

1. A control system for an automatically tuned fretted stringed instrument adapted for use with a capo installed on one fret, said instrument having a plurality of strings, each string having an actuator connected thereto, said instrument further having a transducer coupled to said strings, said control system comprising:

a processor adapted to be coupled to the transducer and to the actuators, said processor including means for receiving a transducer signal from said transducer, means for obtaining the measured frequency of each of said plurality of strings from said transducer signal, means for scaling said measured frequency of each string by a capo scale factor, means for generating control signals in accordance with the scaled frequencies, and means for outputting said control signals to said actuators.

2. The control system of claim 1 wherein said instrument has twelve frets per octave and wherein said capo scale factor is $2^{-(n/12)}$, where n is the number of the fret on which the capo is installed and n=0 if no capo is installed.

3. The control system of claim 1 adapted for use with a capo sensor, coupled to said processor, wherein said capo sensor senses an installed capo.

4. The control system of claim 1 wherein said processor detects an installed capo based on the measured string frequency of one of the strings.

5. The control system of claim 4 wherein said processor determines on which fret, n, a capo is installed based on the relationship:

$$f_{meas}/f_{open}=2^{(n/12)},$$

where $f_{meas}$ and $f_{open}$ are the measured and target open frequencies, respectively, of said string.

6. The control system of claim 5 wherein said processor determines n based on the measured string frequencies of more than one string.

7. The control system of claim 1 further including an operator interface coupled to said processor, for receiving operator input from an instrument operator.

8. The control system of claim 7 wherein said operator input indicates an installed capo.

9. The control system of claim 8 wherein said operator input further indicates on which fret said capo is installed.

10. The control system of claim 8 wherein said processor determines on which fret said capo is installed.

11. The control system of claim 10 wherein said processor determines on which fret, n, said capo is installed based on the relationship:

$$f_{meas}/f_{open}=2^{(n/12)},$$

where $f_{meas}$ and $f_{open}$ are the measured and target open frequencies, respectively, of one of the strings.

12. The control system of claim 7 wherein said operator interface further comprises means for displaying instrument conditions to said instrument operator.

13. The control system of claim 1 wherein said means for generating control signals comprises a calibration function.

14. The control system of claim 13 wherein said calibration function relates the actuator position for a given string to the target open frequency of said string.

15. The control system of claim 14 wherein said calibration function relates the actuator position for a given string to the target open frequency to the first power and to the target open frequency squared of said string.

16. The control system of claim 14 wherein said calibration function relates the actuator position for a given string to the target open frequencies of each of said plurality of strings.

17. The control system of claim 16 wherein said calibration function relates the actuator position for a given string to the target open frequencies to the first power and to the target open frequencies squared of each of said plurality of strings.

18. The control system of claim 14 wherein said means for generating control signals further includes modifying means for modifying said calibration function.

19. The control system of claim 18 wherein said calibration function is modified by adding a constant term to said calibration function.

20. The control system of claim 18 wherein said calibration function is modified by a function of the difference between the scaled frequency of a given string and the target open frequency of said string.

21. The control system of claim 18 wherein said calibration function is modified by a function of the difference between the actuator position computed for the target open frequency of a given string and the actuator position computed for the scaled frequency of said string.

22. The control system of claim 21 wherein said difference is subtracted from said calibration function.

23. The control system of claim 18 wherein said modifying means comprises a closed-loop system for adjusting the actuator position of a given string until the scaled frequency is approximately equal to said target open frequency.

24. The control system of claim 23 wherein said calibration function is modified by a function of the difference between the new actuator positions and the previous actuator positions.

25. The control system of claim 18 further including means for storing the modified calibration function.

26. The control system of claim 13 wherein said processor further comprises means for generating said calibration function.

27. The control system of claim 26 wherein said means for generating a calibration function comprises means for acquiring $f_k$ and $x_k$, the measured frequency and actuator positions, respectively, for a given string at a plurality, k, of actuator positions, and means for generating therefrom a function relating x to f for said given string.

28. The control system of claim 26 wherein said means for generating a calibration function comprises means for acquiring $f_{jk}$ and $x_{jk}$ the measured frequency and actuator positions, respectively, for j strings, each string at a plurality, k, of actuator positions, and means for generating therefrom a function relating $x_j$ for a given actuator j to $f_j$ for all j strings.

29. The control system of claim 13 wherein said calibration function can be used to calculate target actuator positions for a plurality of tuning configurations.

30. The control system of claim 1 wherein said means for generating control signals comprises a closed-loop system.

31. The control system of claim 30 wherein said closed-loop system takes the difference between the scaled frequency of a given string and the target open frequency of said string and generates an error signal therefrom, and wherein said control signal is a function of said error signal.

32. An automatically tuned fretted stringed instrument adapted for use with a capo installed on one fret, comprising:

a plurality of strings;

a plurality of actuators, one of said actuators connected to each of said strings;

a transducer coupled to said strings; and a processor coupled to said transducer and to said actuators, said processor including means for receiving a transducer signal from said transducer, means for obtaining the measured frequency of each of said plurality of strings from said transducer signal, means for scaling said measured frequency of each string by a capo scale factor, means for generating control signals in accordance with the scaled frequencies, and means for outputting said control signals to said actuators.

33. The instrument of claim 32 wherein said instrument has twelve frets per octave and wherein said capo scale factor is $2^{-(n/12)}$, where n is the number of the fret on which the capo is installed and n=0 if no capo is installed.

34. The instrument of claim 32 wherein said processor detects an installed capo based on the measured string frequency of one of the strings.

35. The instrument of claim 34 wherein said processor determines on which fret, n, a capo is installed based on the relationship:

$$f_{meas}/f_{open}=2^{(n/12)},$$

where $f_{meas}$ and $f_{open}$ are the measured and target open frequencies, respectively, of said string.

36. The instrument of claim 32 further including a n operator interface coupled to said processor, for receiving operator input from an instrument operator.

37. The instrument of claim 36 wherein said operator input indicates an installed capo.

38. The instrument of claim 37 wherein said operator input further indicates on which fret said capo is installed.

39. The instrument of claim 37 wherein said processor determines on which fret said capo is installed.

40. The instrument of claim 39 wherein said processor determines on which fret, n, said capo is installed based on the relationship:

$$f_{meas}/f_{open}=2^{(n/12)},$$

where $f_{meas}$ and $f_{open}$ are the measured and target open frequencies, respectively, of one of the strings.

41. The instrument of claim 32 wherein said means for generating control signals utilizes a calibration function.

42. The instrument of claim 41 wherein said calibration function relates the actuator position for a given string to the target open frequencies of each of said plurality of strings.

43. The instrument of claim 41 wherein said means for generating control signals further includes modifying means for modifying said calibration function.

44. The instrument of claim 43 wherein said calibration function is modified by adding a constant term to said calibration function.

45. The instrument of claim 43 wherein said calibration function is modified by a function of the difference between the scaled frequency of a given string and the target open frequency of said string.

46. The instrument of claim 43 wherein said calibration function is modified by a function of the difference between the actuator position computed for the target open frequency of a given string and the actuator position computed for the scaled frequency of said string.

47. The instrument of claim 43 further including means for storing the modified calibration function.

48. The instrument of claim 41 wherein said processor further comprises means for generating said calibration function.

49. The instrument of claim 41 wherein said calibration function can be used to calculate target actuator positions for a plurality of tuning configurations.

50. A method for tuning a fretted stringed instrument having an installed capo, said instrument having a plurality of strings, each string having an actuator connected thereto, said instrument further having a transducer coupled to said strings and a processor coupled to said transducer and to said actuators, said method comprising the steps of:

installing a capo on one fret;

strumming said strings;

measuring the frequency of each of said plurality of strings from a transducer signal;

scaling the measured frequency of each string by a capo scale factor;

generating control signals in accordance with the scaled frequencies; and outputting said control signals to said actuators.

51. The method of claim 50 wherein said instrument has twelve frets per octave and wherein said capo scale factor is $2^{-(n/12)}$, where n is the number of the fret on which the capo is installed.

52. The method of claim 50 further comprising the step of determining on which fret said capo is installed from the measured frequency of one of the strings.

53. The method of claim 50 wherein said step of generating control signals comprises the steps of:

providing a calibration function relating the actuator position for a given string to the target open frequencies of each of said plurality of strings;

inserting said scaled frequencies into said calibration function to compute new actuator positions;

computing the difference between said new actuator positions and the previous actuator positions, said previous actuator positions computed by inserting said target open frequencies into said calibration function; and modifying said calibration function by adding said difference to said calibration function.

* * * * *